US012320093B2

(12) United States Patent
Dorman et al.

(10) Patent No.: US 12,320,093 B2
(45) Date of Patent: Jun. 3, 2025

(54) CRAWLER DOZER BLADE CORNER VISIBILITY

(71) Applicant: Deere & Company, Moline, IL (US)

(72) Inventors: Michael R. Dorman, Dubuque, IA (US); Nathan J. Horstman, Peosta, IA (US); Todd R. Simms, Peosta, IA (US); Ryan R. Neilson, Dubuque, IA (US); Michael R. Tigges, Dubuque, IA (US)

(73) Assignee: Deere & Company, Moline, IL (US)

( * ) Notice: Subject to any disclaimer, the term of this patent is extended or adjusted under 35 U.S.C. 154(b) by 881 days.

(21) Appl. No.: 17/494,366

(22) Filed: Oct. 5, 2021

(65) Prior Publication Data

US 2023/0103653 A1 Apr. 6, 2023

(51) Int. Cl.
*E02F 3/76* (2006.01)
*E02F 3/84* (2006.01)

(52) U.S. Cl.
CPC ..... *E02F 3/7618* (2013.01)

(58) Field of Classification Search
CPC . E02F 3/7609; E02F 3/76; E02F 3/844; E02F 3/7631; E02F 3/7627; E02F 3/7613
See application file for complete search history.

(56) References Cited

U.S. PATENT DOCUMENTS 2,230,704 A * 2/1941 Sorensen ..... E02F 3/7613 172/815
2,827,717 A * 3/1958 Duke ..... E02F 3/7618 172/826
3,441,092 A * 4/1969 Drone ..... E02F 3/8157 172/826
4,554,979 A * 11/1985 Foley ..... E02F 3/80 172/813
5,069,296 A 12/1991 Horsch
7,753,620 B2 7/2010 Kötting et al.
8,333,250 B2 12/2012 Knepper et al.
(Continued)

FOREIGN PATENT DOCUMENTS

EP 2578754 A2 * 4/2013 ..... E02F 3/7618
GB 2036130 A * 6/1980 ..... E02F 3/8157

OTHER PUBLICATIONS

John Deere K-Series 1050K Crawler Dozer Brochure (16 pages) (undated but admitted to be prior art).

(Continued)

*Primary Examiner* — Matthew Troutman
*Assistant Examiner* — Ashley A Kaercher
(74) *Attorney, Agent, or Firm* — Lucian Wayne Beavers; Patterson Intellectual Property Law, PC

(57) ABSTRACT

A crawler dozer includes a main frame having a longitudinal central axis. A push frame includes left and right push beams. A dozer blade is pivotally connected to the left and right push beams. At least one tilt cylinder is connected between the dozer blade and at least one of the left and right push beams. The tilt cylinder includes a larger cylinder portion pivotally connected to the dozer blade and a smaller piston portion pivotally connected to the at least one of the left and right push beams. The tilt cylinder includes a cylinder axis diverging laterally outward relative to the longitudinal central axis of the main frame in a forward direction by a splay angle of at least 2 degrees.

19 Claims, 15 Drawing Sheets

(56) References Cited

U.S. PATENT DOCUMENTS

| | | | | |
|---|---|---|---|---|
| 8,490,712 | B2 | 7/2013 | Genani et al. | |
| 9,440,591 | B2 | 9/2016 | Dendron et al. | |
| 9,526,217 | B2 | 12/2016 | Disabatino | |
| 2011/0114343 | A1* | 5/2011 | Genani | E02F 3/7631 172/810 |
| 2013/0087351 | A1 | 4/2013 | Sulzer | |

OTHER PUBLICATIONS

Dressta TD16N Photos (1 page) (undated but admitted to be prior art).
Caterpillar D8T Photos (1 page) (undated but admitted to be prior art).
Komatsu D155 Photos (1 page) (undated but admitted to be prior art).

* cited by examiner

CRAWLER DOZER BLADE CORNER VISIBILITY

FIELD OF THE DISCLOSURE

The present disclosure relates to improved designs for the dozer blade and related structures of a crawler dozer, and particularly for a crawler dozer having the dozer blade mounted outside of the crawler tracks.

BACKGROUND

It is desirable to provide an operator of a crawler dozer with good visibility of an interface between the blade corner and the ground. In prior dozers with push beams outside of the crawler tracks, commonly referred to as OSD dozers, the dozer blade may be located sufficiently forward of the crawler tracks that the cutting edge of the dozer blade is visible above the forward ends of the tracks from the operator's station. An exemplary view from the operator's station of such a dozer, in this case a Deere Model 1050K2 dozer is shown in FIG. 11.

This solution is not available, however, when using a tag-link design where a tag-link is attached between the dozer blade and the main frame. A tag-link design reduces overall machine length and necessarily keeps the dozer blade closer to the crawler tracks, such that visibility of the cutting edge of the dozer blade is impeded.

Accordingly, there is a need for improved designs to improve the visibility of the cutting edge of a dozer blade in OSD dozers, and particularly in OSD dozers using a tag-link design.

SUMMARY OF THE DISCLOSURE

In one embodiment a crawler dozer includes a main frame having a longitudinal central axis extending between a front and a rear of the main frame. Left and right crawler tracks may support the main frame from a ground surface. An operator's station may be supported from the main frame. A push frame may include left and right push beams located laterally outside of the left and right crawler tracks, respectively. A dozer blade may be pivotally connected to the left and right push beams. At least one tilt cylinder may be connected between the dozer blade and at least one of the left and right push beams and configured to tilt the dozer blade about a tilt axis transverse to the longitudinal central axis, the at least one tilt cylinder including a cylinder portion pivotally connected to the dozer blade and a piston portion pivotally connected to the at least one of the left and right push beams, the cylinder portion having a larger outside cross-sectional dimension than the piston portion. The at least one tilt cylinder may include a cylinder axis diverging laterally outward relative to the longitudinal central axis of the main frame in a forward direction by a splay angle of at least 2 degrees such that a view from the operator's station of a lower laterally outer corner portion of the dozer blade is provided along a line of sight passing laterally inward of the piston portion of the at least one tilt cylinder.

In another embodiment a crawler dozer includes a main frame having a longitudinal central axis extending between a front and a rear of the main frame. Left and right crawler tracks may support the main frame from a ground surface. An operator's station may be supported from the main frame. A push frame may include left and right push beams located laterally outside of the left and right crawler tracks, respectively. A dozer blade may be pivotally connected to the left and right push beams. At least one tilt cylinder may be connected between the dozer blade and at least one of the left and right push beams and configured to tilt the dozer blade about a tilt axis transverse to the longitudinal central axis. The crawler dozer may include at least three additional features selected from the group of additional features consisting of:

(1) at least one tilt cylinder including a cylinder portion pivotally connected to the dozer blade and a piston portion pivotally connected to the a respective one of the push beams, the cylinder portion having a larger outside cross-sectional dimension than the piston portion;

(2) the at least one tilt cylinder including a cylinder axis diverging laterally outward relative to the longitudinal central axis of the main frame in a forward direction by a splay angle of at least 2 degrees;

(3) the push beam connected to the at least one tilt cylinder including a front end portion connected to the dozer blade, a rear end portion connected to the respective crawler track, and an intermediate portion extending from the rear end portion to the front end portion, the front end portion being offset laterally inward relative to the intermediate portion towards the longitudinal central axis of the main frame;

(4) a tilt cylinder guard located above the cylinder portion of the at least one tilt cylinder;

(5) a plurality of hoses connected to the at least one tilt cylinder, the hoses being routed upward from the tilt cylinder and laterally inward toward the central longitudinal axis of the main frame away from the tilt cylinder;

(6) the front end portion of the respective push beam connected to the at least one tilt cylinder including a cut-away front laterally outside corner; and (7) the dozer blade including a front blade surface and a blade supporting structure located behind the front blade surface, and the blade supporting structure including a cut-away adjacent a lower laterally outer corner portion of the dozer blade.

Numerous objects, features and advantages of the present invention will be readily apparent to those skilled in the art upon a review of following description in conjunction with the accompanying drawings.

DETAILED DESCRIPTION

Figure 1A:
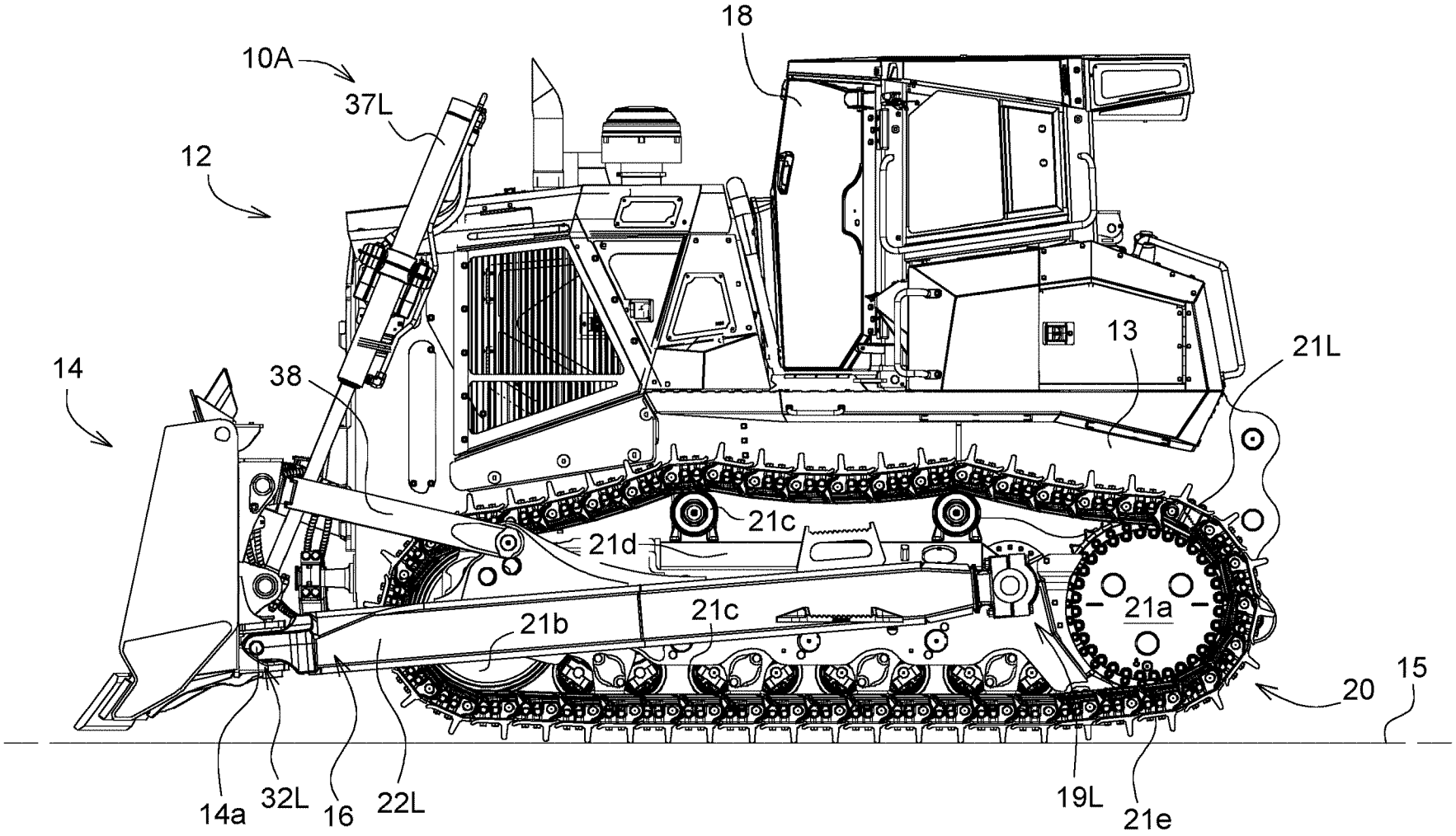
FIG. 1A is a left side view of a first embodiment of a work vehicle, for example crawler dozer, having a tilt cylinder only on the right side of the dozer blade.
Figure 1B:
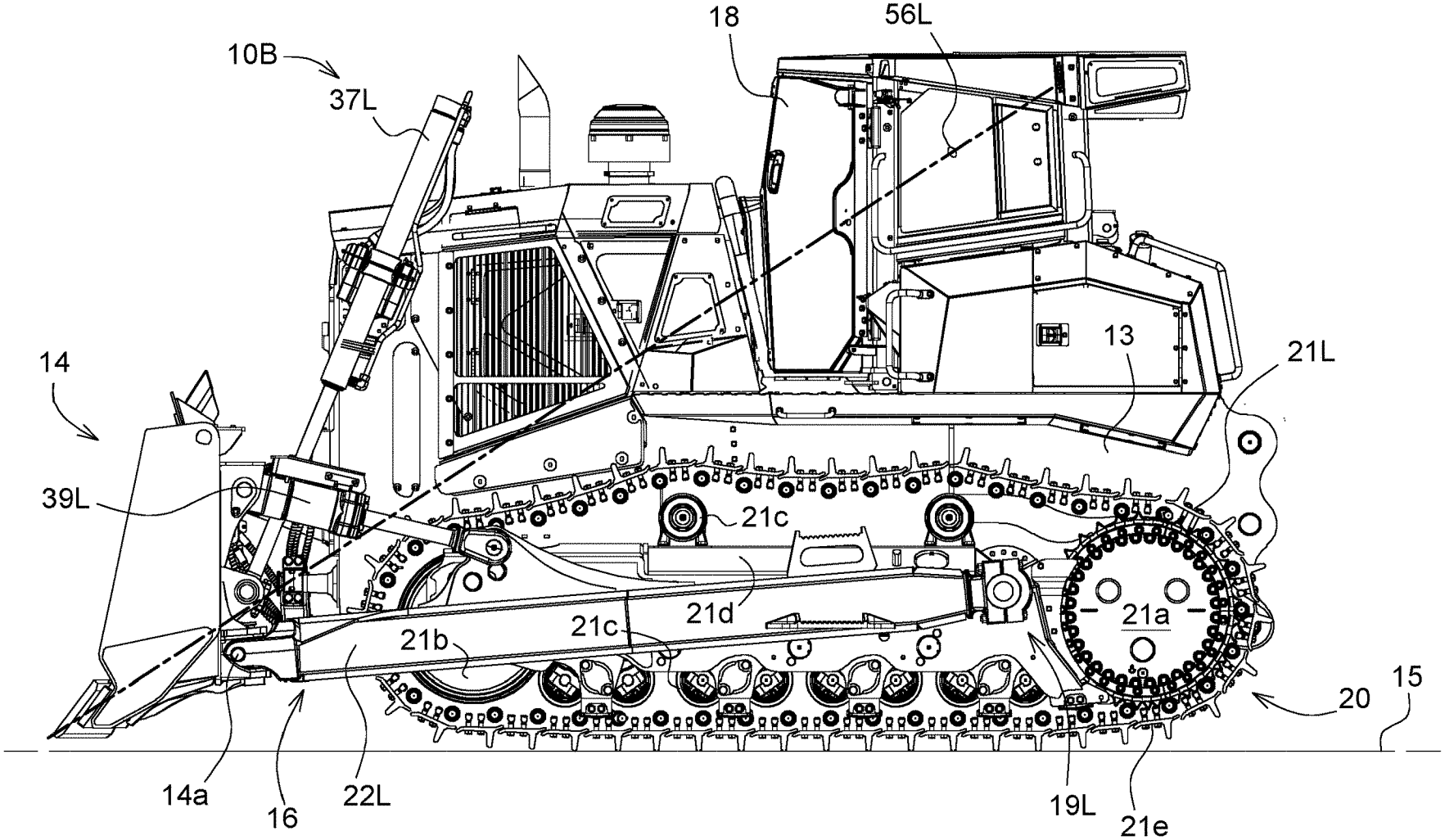
FIG. 1B is a left side view of a second embodiment of the work vehicle, having tilt cylinders on both sides of the dozer blade.
Figure 2A:
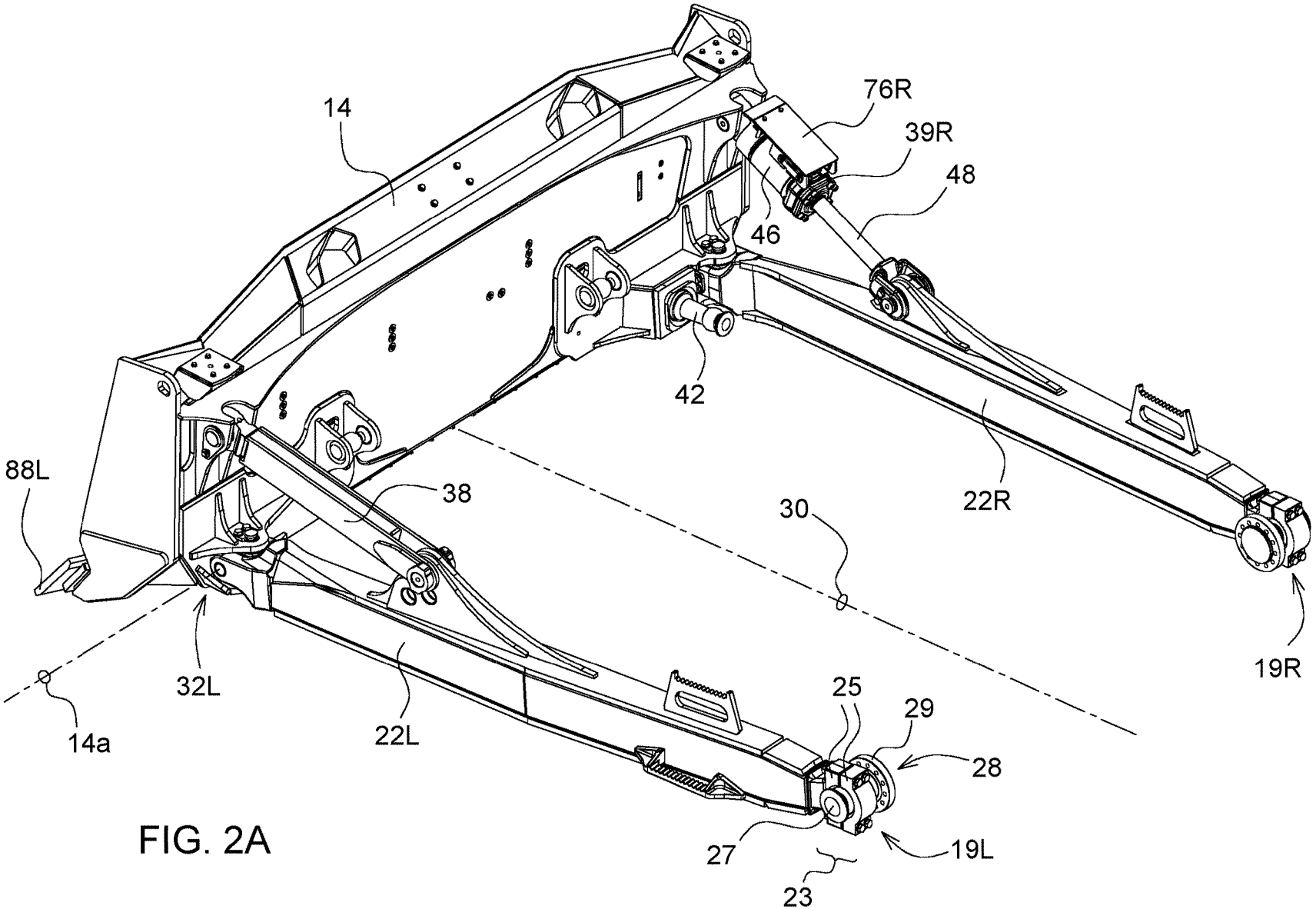
FIG. 2A is a left rear perspective view of the push frame and dozer blade assembly for the work vehicle of FIG. 1A.
Figure 2B:
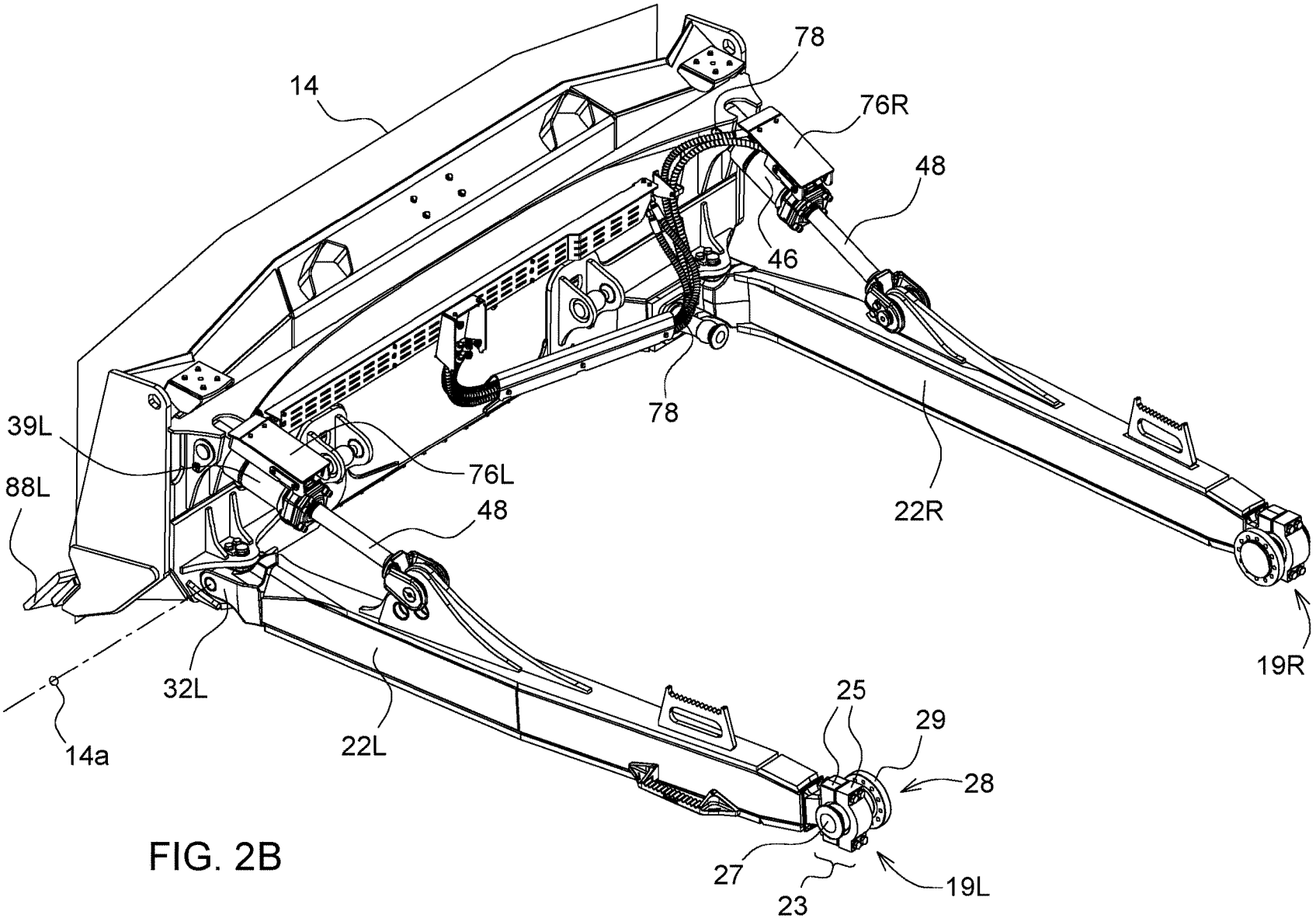
FIG. 2B is a left rear perspective view of the push frame and dozer blade assembly for the work vehicle of FIG. 1B.
Figure 4A:
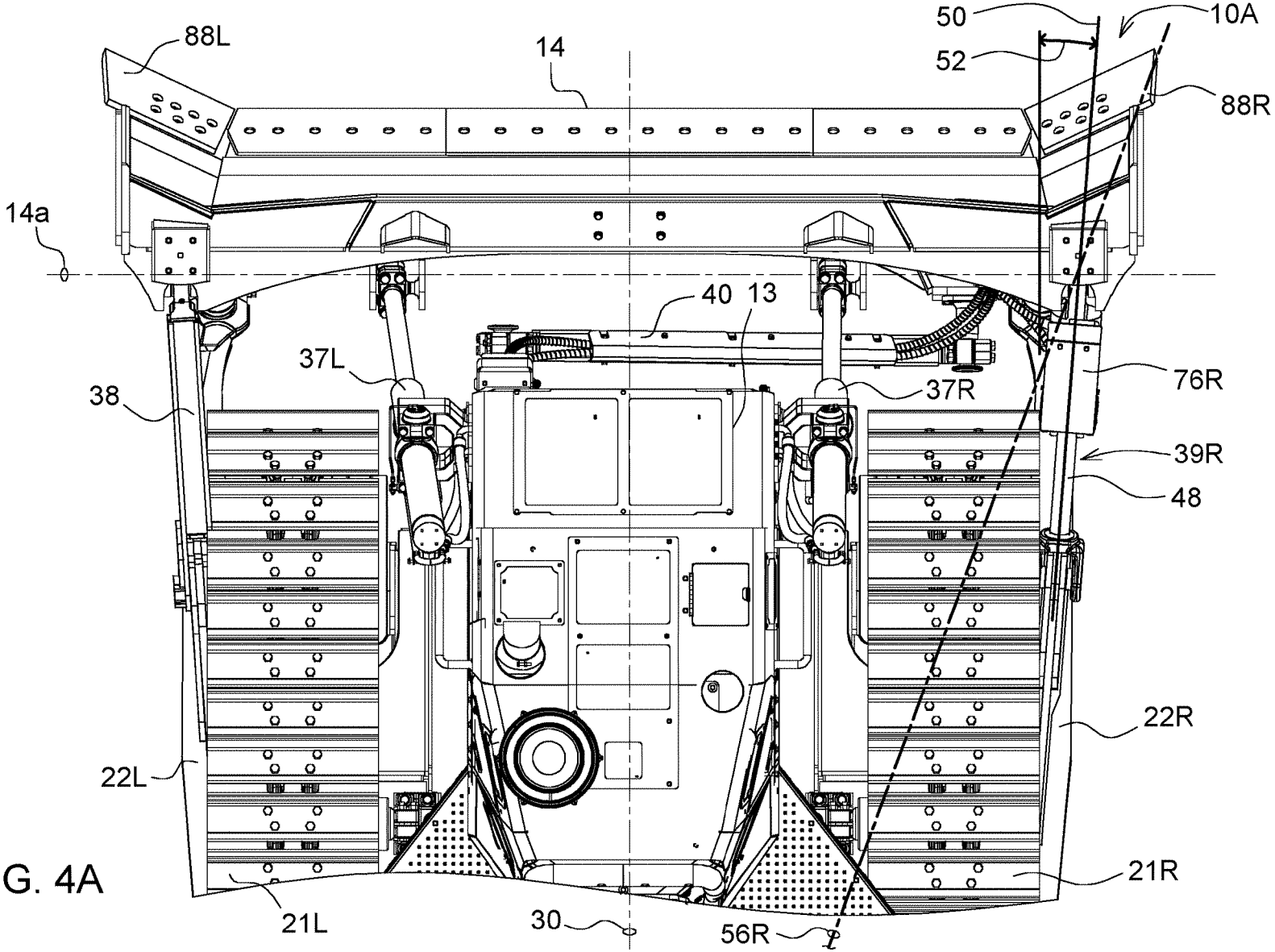
FIG. 4A is a plan view of the forward portion of the work vehicle of FIG. 1A.
Figure 4B:
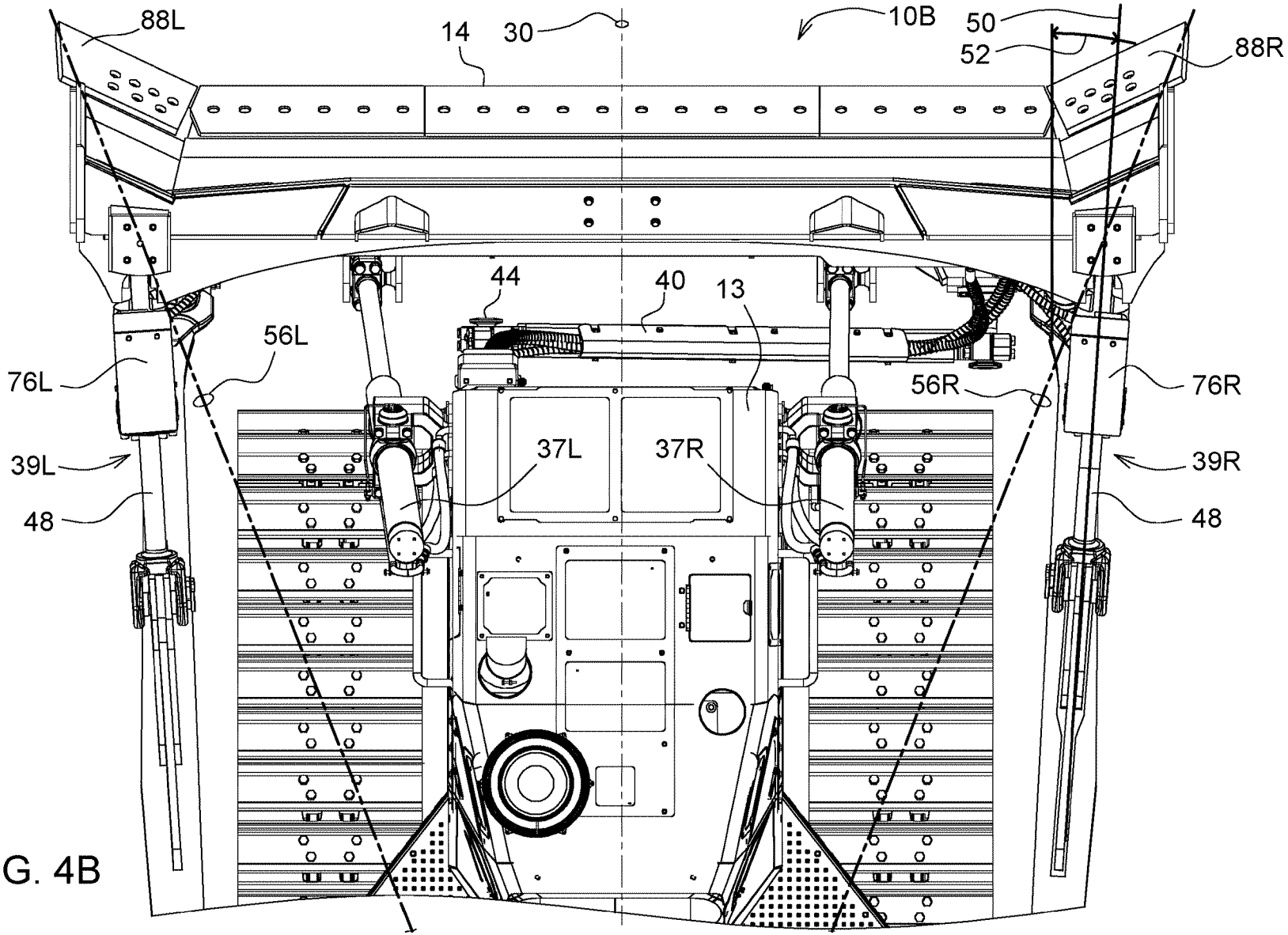
FIG. 4B is a plan view of the forward portion of the work vehicle of FIG. 1B.

A first embodiment of a work vehicle 10A is shown in FIGS. 1A, 2A and 4A. A second embodiment of a work vehicle 10B is shown in FIGS. 1B, 2B and 4B. As is further explained below the work vehicle 10A has a single tilt cylinder 39R located between a dozer blade 14 and a right push beam 22R, whereas the work vehicle 10B has two tilt cylinders 39L and 39R located between the dozer blade 14 and the left and right push beams 22L and 22R, respectively. The structures surrounding each tilt cylinder have been modified to improve a view from an operator's station 18 of a lower laterally outer corner portion of the dozer blade along a line of sight passing laterally inward of a piston portion of each of the tilt cylinders. In all other relevant aspects, the two work vehicles 10A and 10B are substantially similar.

Referring to FIG. 1A, there is shown a work vehicle 10A exemplarily configured as a crawler dozer. The vehicle 10A includes a tractor 12, a blade 14, and a push frame 16 interconnecting the tractor 12 and the blade 14. The work vehicle 10A includes a main frame 13 having a longitudinal central axis 30 extending between a front and a rear of the main frame 13.

The blade 14 is configured to push large quantities of soil, sand, rubble, or other material, earthen or otherwise. The tractor 12 includes an operator's station 18 from which a human operator can control the vehicle 10A and a tracked undercarriage 20 configured to propel the vehicle 10A. The operator's station 18 is supported from the main frame 13.

The undercarriage 20 has left and right crawler tracks or track assemblies 21L and 21R positioned on laterally opposite sides of the tractor 12 for propulsion of the vehicle 10A, the left track assembly is shown in FIG. 1A in simplified form at 21L. The left and right crawler tracks 21L and 21R support the main frame 13 from a ground surface 15. Each track assembly has a rear drive sprocket 21*a* rotatably attached to the main frame 13 of the tractor 12, a front idler 21*b*, upper and lower rollers 21*c* rotatably attached to a track frame 21*d* of the track assembly 21, and a track 21*e* shown diagrammatically and trained about the drive sprocket 21*a*, the idler 21*b*, and the rollers 21*c*. The track 21*e* has a closed-loop chain, having two rows of interconnected links, and ground-engaging shoes mounted to the chain thereabout for engagement with the ground. A track chain tension adjuster is mounted to the track frame 21*d* and is attached to the idler 21*b*, movable a distance fore-and-aft relative to the track frame 21*d*, to press the idler 21*b* against the chain to tension the track 21*e*.

Referring to FIG. 2A, the push frame 16 includes left and right push-beams 22L and 22R. The push frame 16 is attached pivotally to the tractor 12 and the blade 14 therebetween. The push-beams 22L and 22R are attached pivotally to and positioned laterally outside of the left and right crawler tracks 21L and 21R using a pair of rearward pivot couplings 19L and 19R. As such, the push-beams 22L and 22R are positioned on laterally opposite sides of the undercarriage 20 relative to a longitudinal central axis 30 of the push frame 16 and the vehicle 10A. The push-beams 22L and 22R are attached pivotally to the blade 14 using a pair of forward pivot couplings 32L and 32R. The push-beams 22L and 22R may be attached pivotally to the undercarriage 20 and the blade 14 in any suitable manner.

Exemplarily, each rearward pivot coupling such as the left rearward pivot coupling 19L may include a clamp 23 and a trunnion 28. The clamp 23 may have a pair of C-shaped jaws or caps 25. A first of the jaws 25 may be welded to a plate of the clamp 23 welded to the rearward end of the push-beam 22L. The first jaw 25 may have a slightly larger inner diameter than a second of the jaws 25 so as to receive a half-moon bushing of the clamp 23 therein. A ball 27 of the trunnion 28 may be received in the clamp 23 between the jaws 25 with the half-moon bushing positioned between the ball 27 and the first jaw 25. The second jaw 25 may be bolted to the first jaw 25 using a threaded top bolt of the clamp 23 and a threaded bottom bolt of the clamp 23. The jaws 25 may be shimmed as needed using one or more upper shims of the clamp 23 and one or more lower shims of the clamp 23, the shims being positioned between the first and second jaws 25 and perforated to receive the respective bolt therethrough. The ball 27 may be welded to a mounting plate 29 of the trunnion 28 bolted to the respective track frame.

A pair of trunnion-mounted hydraulic lift cylinders 37L and 37R, the left lift cylinder 37L of which is shown, for example, in FIG. 1A, is attached pivotally to the tractor 12 and to the blade 14 using a pair of pivot couplings. The operator can raise and lower the blade 14 relative to the tractor 12 using the lift cylinders 37L and 37R.

The vehicle 10A has a first or pitch link 38 and a second or tilt link or tilt cylinder 39R. Exemplarily, each link 38, 39R has an adjustable length, and is attached pivotally to a respective push-beam 22L or 22R and to an upper portion of the rear of the blade 14 next to an end of the blade 14.

The pitch link 38 may be, for example, a turnbuckle having externally threaded opposite ends and an internally threaded sleeve threaded thereto. As such, the length of the pitch link 38 can be adjusted mechanically to change the pitch of the blade 14 relative to the frame 16. Alternatively, the pitch link 38 may be a fixed-length link.

Referring now to FIGS. 1B, 2B and 4B the work vehicle 10B is substantially similar to the work vehicle 10A, except that instead of the pitch link 38 the work vehicle 10B includes a second tilt cylinder 39L connected between the dozer blade 14 and the left push beam 22L. Each of the tilt cylinders 39L and 39R is configured to tilt the dozer blade 14 about a tilt axis 14*a* transverse to the longitudinal central axis 30.

As best seen in FIGS. 4A and 4B a tag-link 40 extends laterally between the main frame 13 and the dozer blade 14 to support the dozer blade 14 and the push frame 16 against lateral forces acting against the dozer blade 14. A right end of the tag-link 40 is pivotally attached to a pivot pin 42 extending rearwardly from the dozer blade 14. The left end of the tag-link 40 is pivotally attached to a pivot pin 44 extending forwardly from the main frame 13.

Details of construction of the right tilt cylinder 39R are seen in FIGS. 2A, 2B, 4A, 4B and 10. The left tilt cylinder 39L is similarly constructed.

The right tilt cylinder 39R includes a cylinder portion 46 pivotally connected to the dozer blade 14 at pivotal connection 47 and a piston portion 48 pivotally connected to the right push beam 22R at pivotal connection 49. The cylinder portion 46 has a larger outside cross-sectional dimension than the piston portion 48. Alternatively, the piston portion 48 may be described as a portion of the cylinder 39R having a smaller outside cross-section than the cylinder portion 46.

As best seen in the plan views of FIGS. 4A and 4B, the right tilt cylinder 39R includes a cylinder axis 50 diverging laterally outward relative to the longitudinal central axis 30 in a forward direction by a splay angle 52 of at least 2 degrees such that such that a view from the operator's station 18 of a lower laterally outer corner portion 54 of the dozer blade 14 is provided along a line of sight 56R passing laterally inward of the piston portion 48 of the right tilt cylinder 39R. Preferably the splay angle 52 is at least 3 degrees, and more preferably the splay angle 52 is at least 4 degrees.

Figure 5:
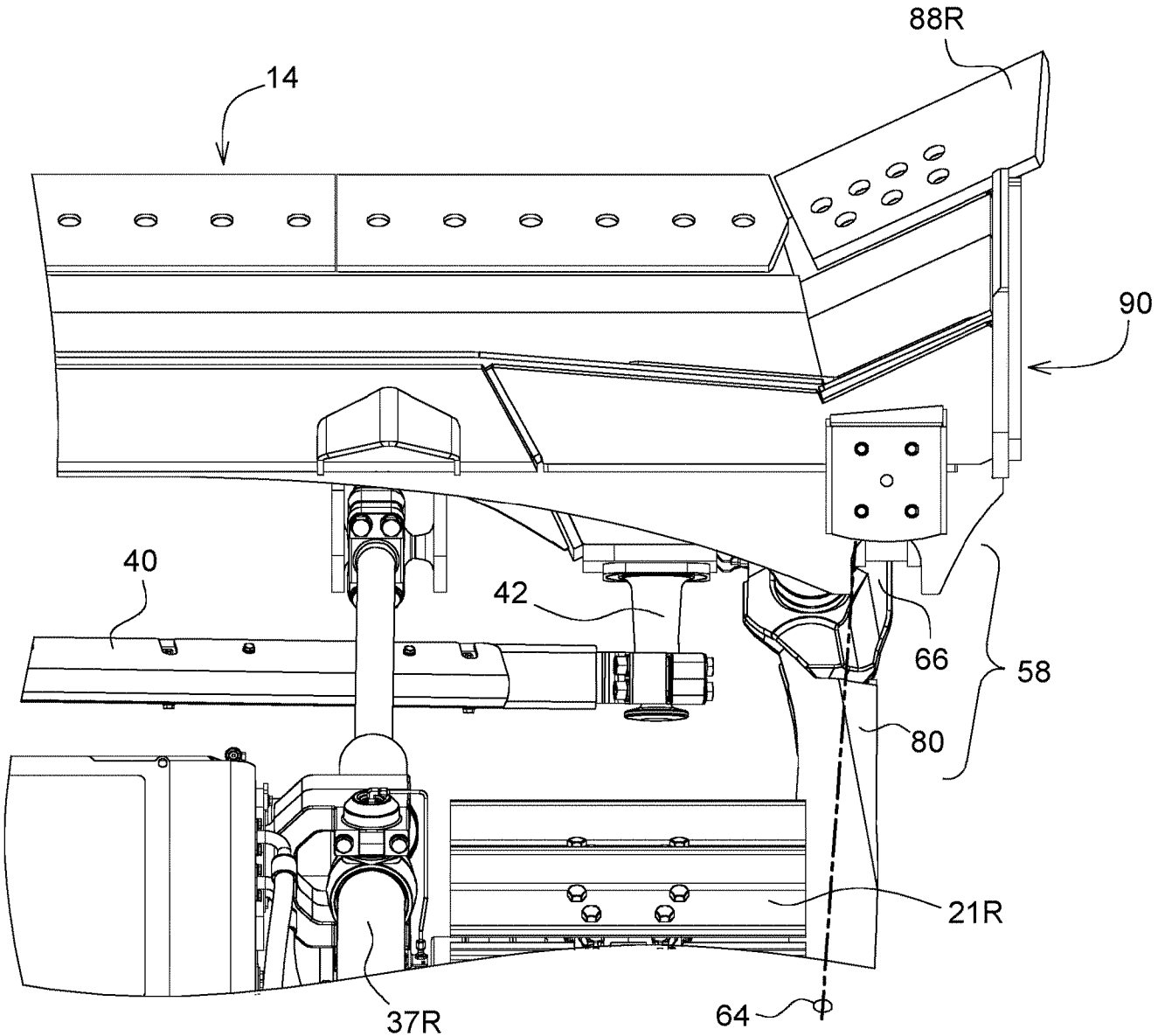
FIG. 5 is an enlarged plan view of the right front portion of either of the work vehicles of FIG. 1A and FIG. 1B.
Figure 7:
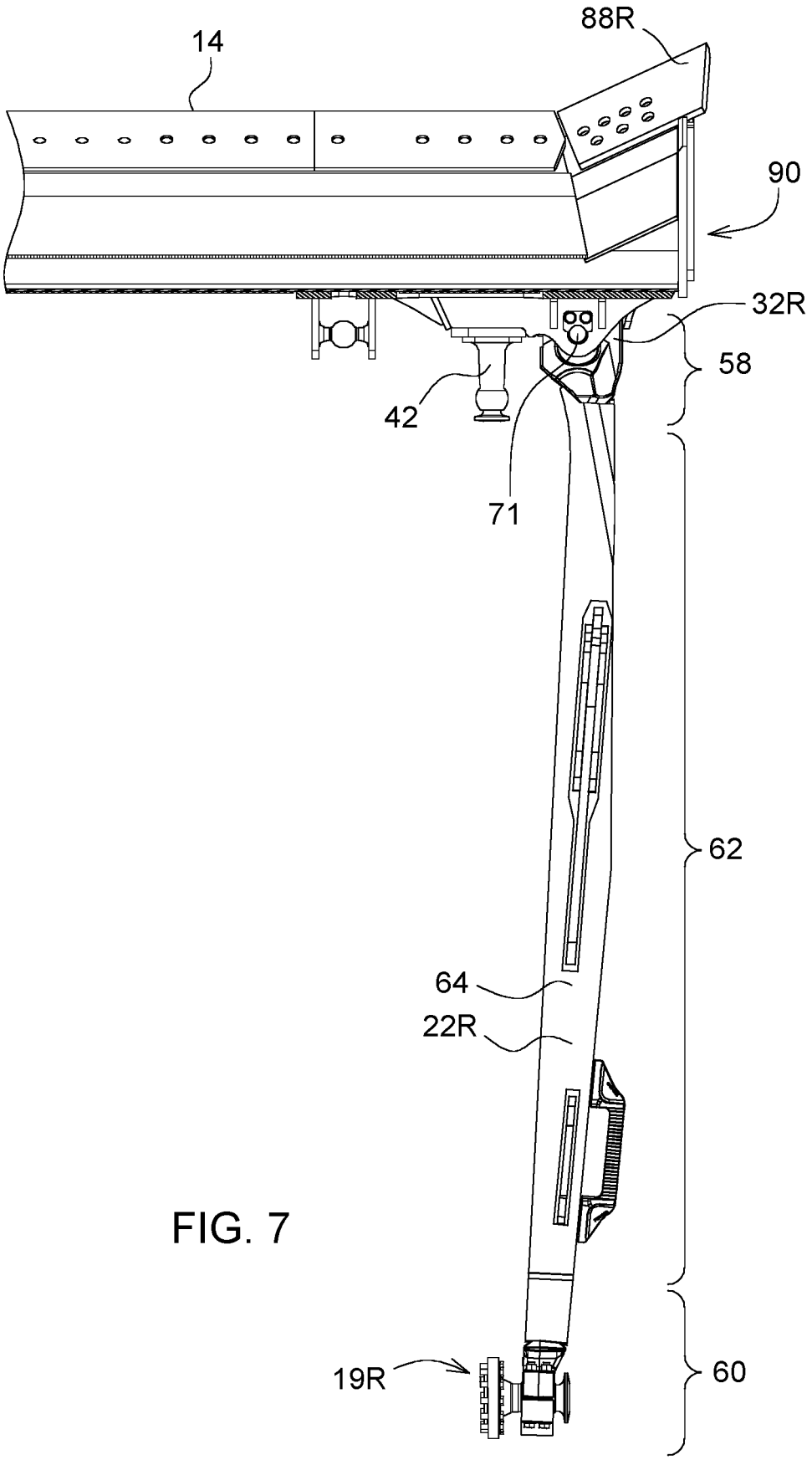
FIG. 7 is an enlarged plan view of the right push beam and the right portion of the dozer blade of either of the work vehicles of FIG. 1A and FIG. 1B.

A further improvement in the view of the lower laterally outer corner portion 54 of the dozer blade 14 along the line of sight 56R may be provided by providing a laterally inward offset of a forward portion of the right push beam 22R. This is best seen in FIGS. 5 and 7. The right push beam 22R includes a front end portion 58 connected to the dozer blade 14 at the right forward pivot coupling 32R. A rear end portion 60 of right push beam 22R is connected to the right crawler track assembly 21R at the right rear pivot coupling 19R. An intermediate portion 62 of right push beam 22R extends from the rear end portion 60 to the front end portion 58 along a beam axis 64. The front end portion 58 is offset laterally inward towards the longitudinal central axis 30 of the main frame 13 relative to the intermediate portion 64.

The right forward pivot coupling 32R includes a yoke 66 received about a pivot block 68. A horizontal pivot pin 70 connects the yoke 66 to the pivot block 68 to in part define the tilt axis 14*a* of the blade 14. The pivot block 68 is in turn connected by a vertical pivot pin 71 to upper and lower flanges 72 and 74 extending rearward from blade 14. As best seen in FIG. 7 the laterally inward offset of the front end portion 58 of the right push beam 22R results in placement of the vertical pivot pin 71 substantially laterally inward of the beam axis 64. This further opens up the line of sight 56R from the operator's station to the lower laterally outer corner portion 54 of the dozer blade 14.

Figure 6:
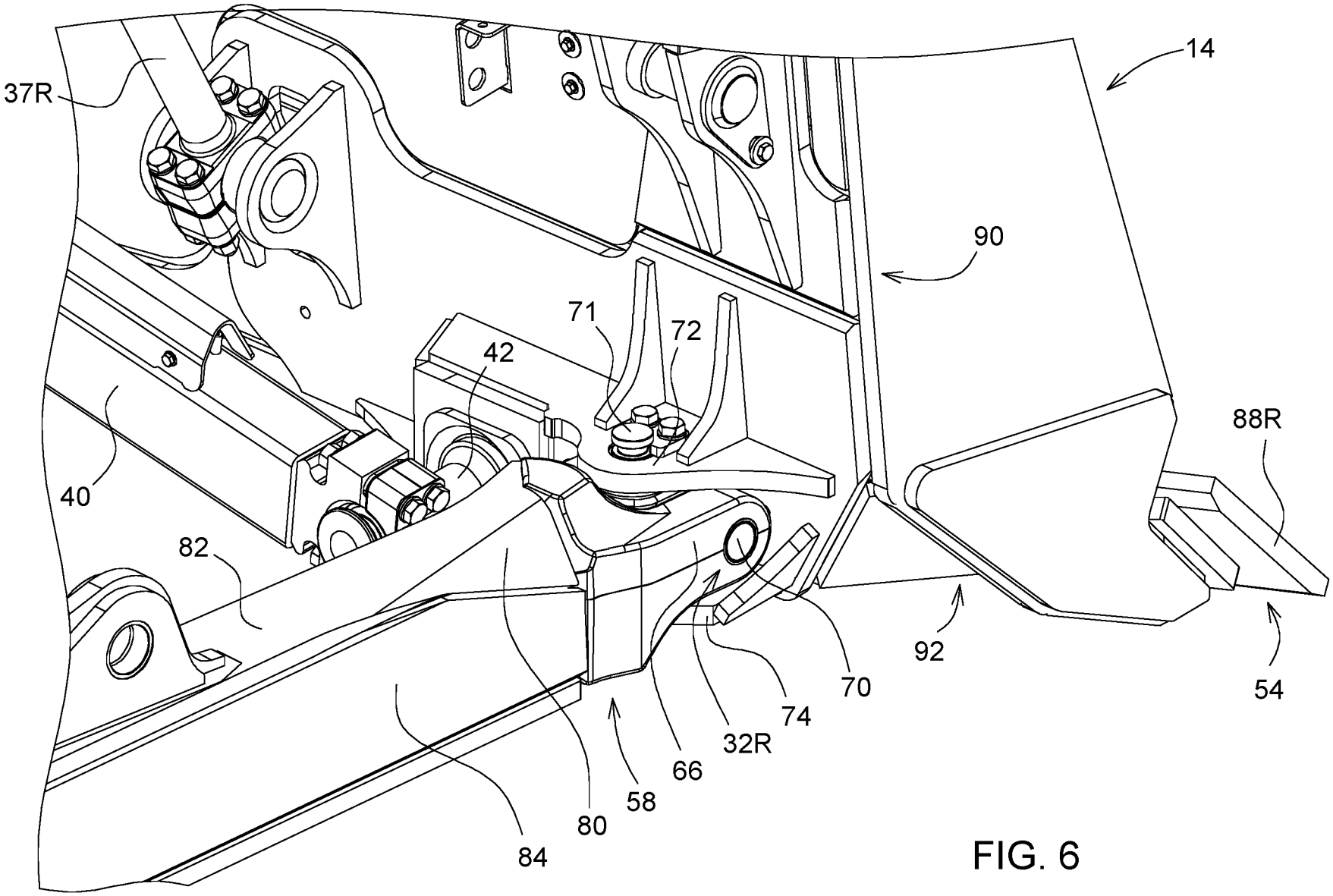
FIG. 6 is an enlarged perspective view of the right front portion of either of the work vehicles of FIG. 1A and FIG. 1B.

A still further improvement in the view of the lower laterally outer corner portion 54 of the dozer blade 14 along the line of sight 56R may be provided by providing a cut-away front laterally outside corner 80 on the right push beam 22R. As best seen in FIG. 6 the cut-away 80 may be formed as a bevel between a top surface 82 and a right side surface 84 of the right push beam 22R adjacent the yoke 66. As can best be seen from FIG. 12 the cut-away 80 is preferably hidden behind the right crawler track 21R when viewed from the operator's station 18 along the line of sight 56R.

Tilt cylinder guards 76L and 76R may be located above the cylinder portions 46 of the left and right tilt cylinders 39L and 39R, respectively. Each tilt cylinder guard may be configured such that the tilt cylinder guard covers no more of a respective lower laterally outer corner portion of the dozer blade 14 when viewed from the operator's station than does its respective tilt cylinder. This further enhances the line of sight from the operator's station to the lower laterally outer corner portions of the dozer blade 14.

Each tilt cylinder 39L and 39R may have a plurality of hoses 78 connected thereto. As shown in FIG. 2B for the right tilt cylinder 39R, the hoses 78 may be routed upward from the tilt cylinder 39R and laterally inward toward the central longitudinal axis 30 of the main frame 13 away from the tilt cylinder 39R. This further enhances the line of sight 56R from the operator's station 18 to the lower laterally outer corner portion 54 of the dozer blade 14 by placing those hoses 76 out of the line of sight.

Figure 3:
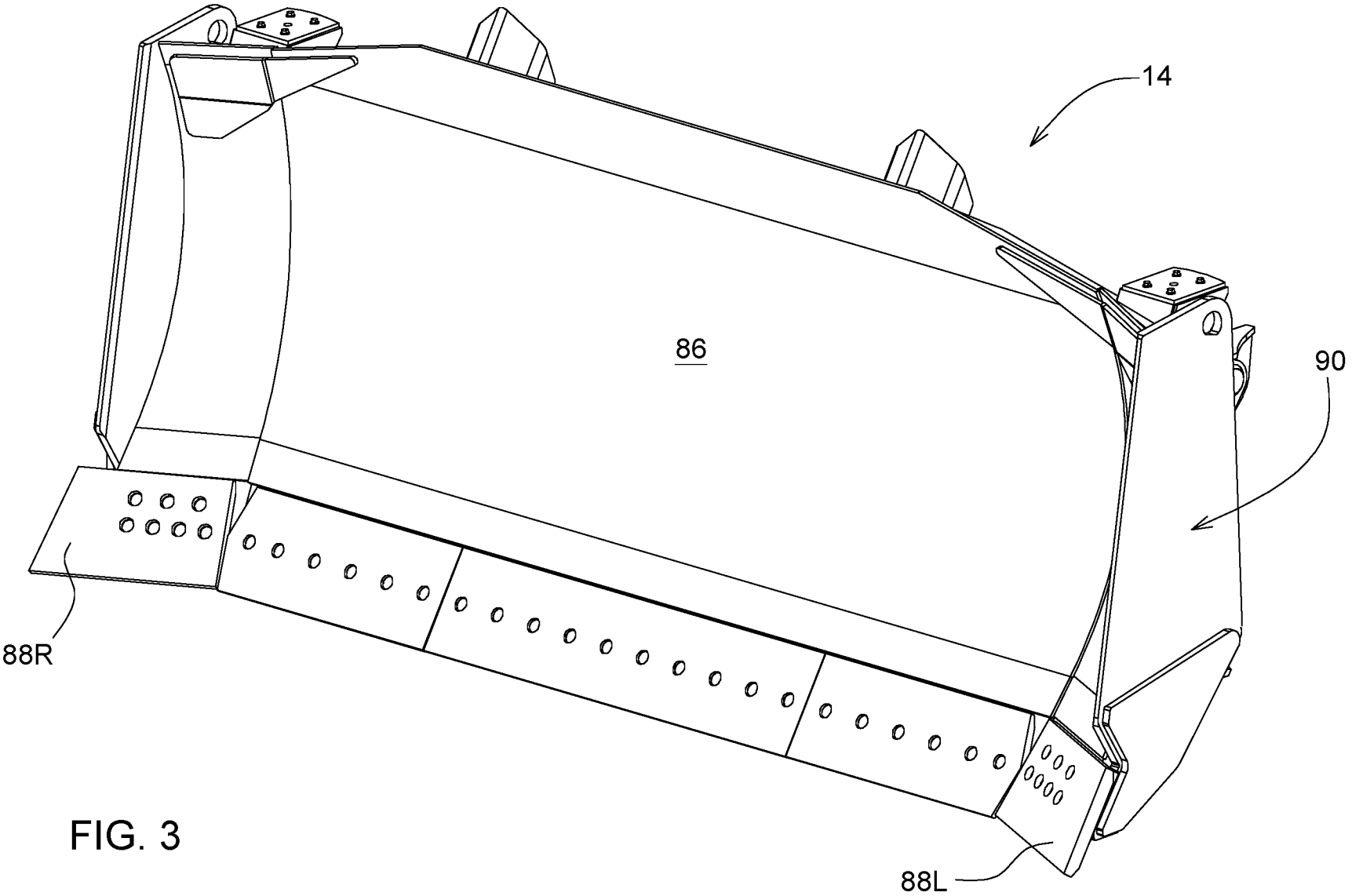
FIG. 3 is left front perspective view of the dozer blade.
Figure 8:
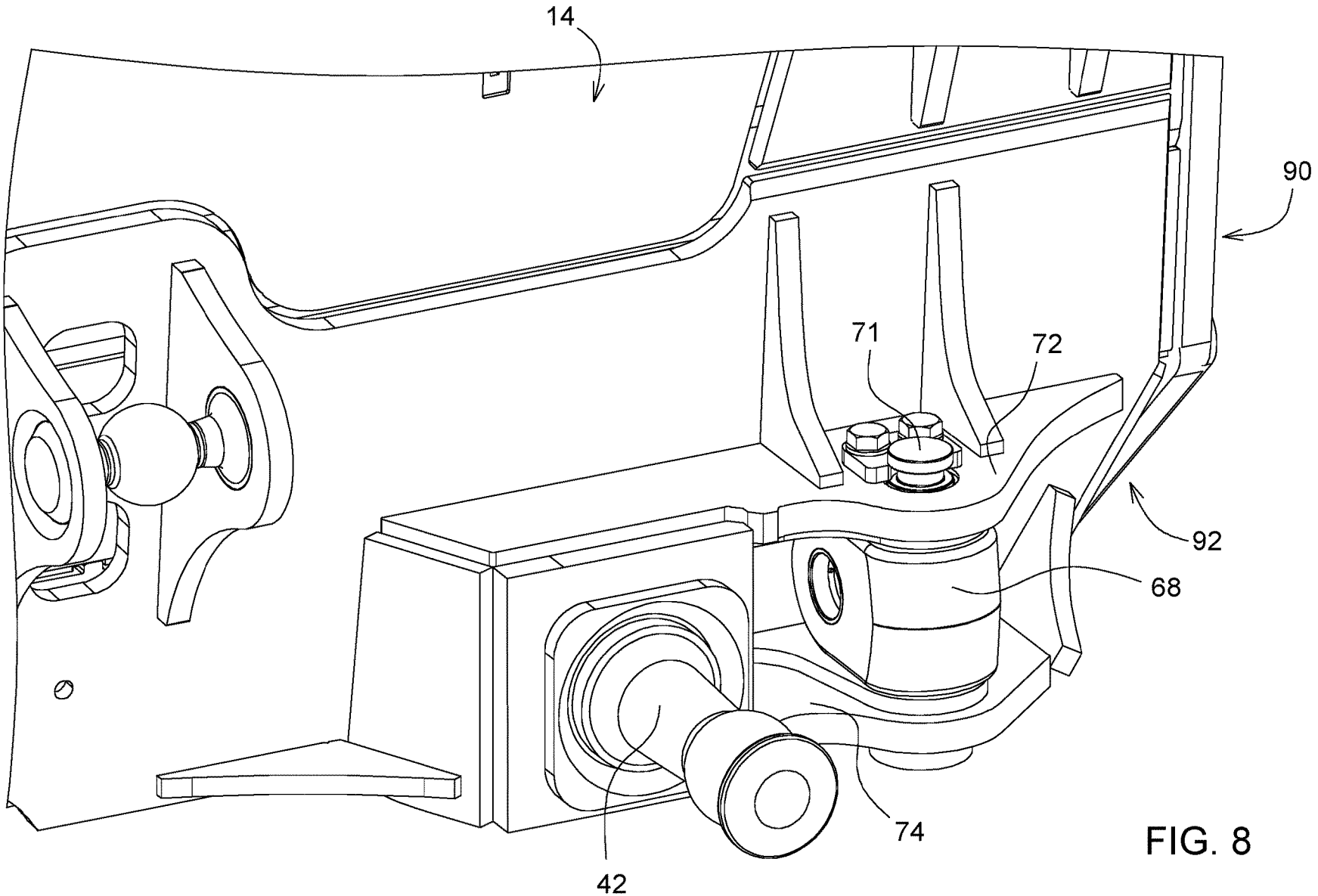
FIG. 8 is an enlarged upper rear perspective view of the right portion of the dozer blade for either of the work vehicles of FIG. 1A and FIG. 1B.
Figure 9:
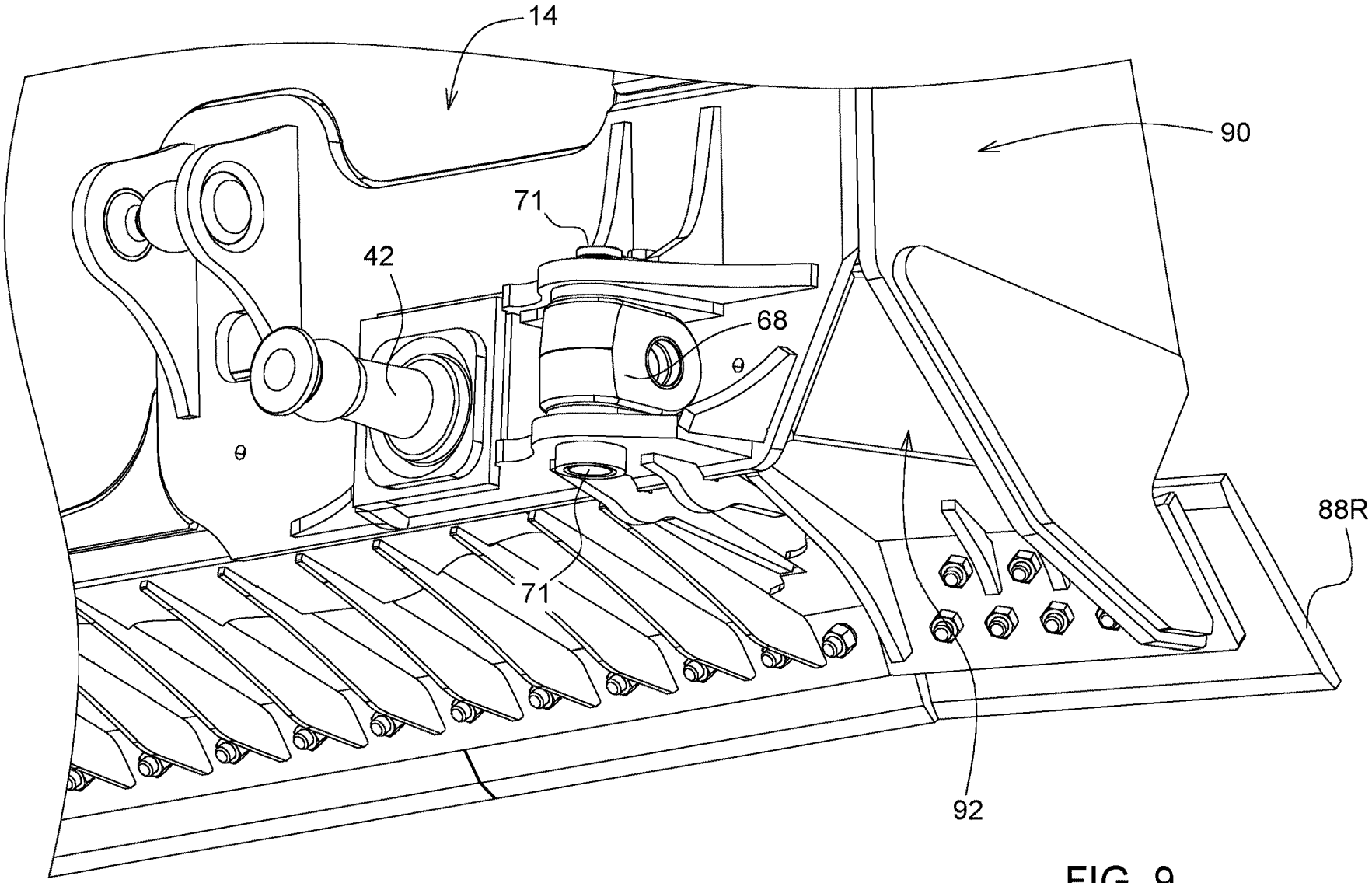
FIG. 9 is an enlarged lower rear perspective view of the right portion of the dozer blade for either of the work vehicles of FIG. 1A and FIG. 1B.
Figure 10:
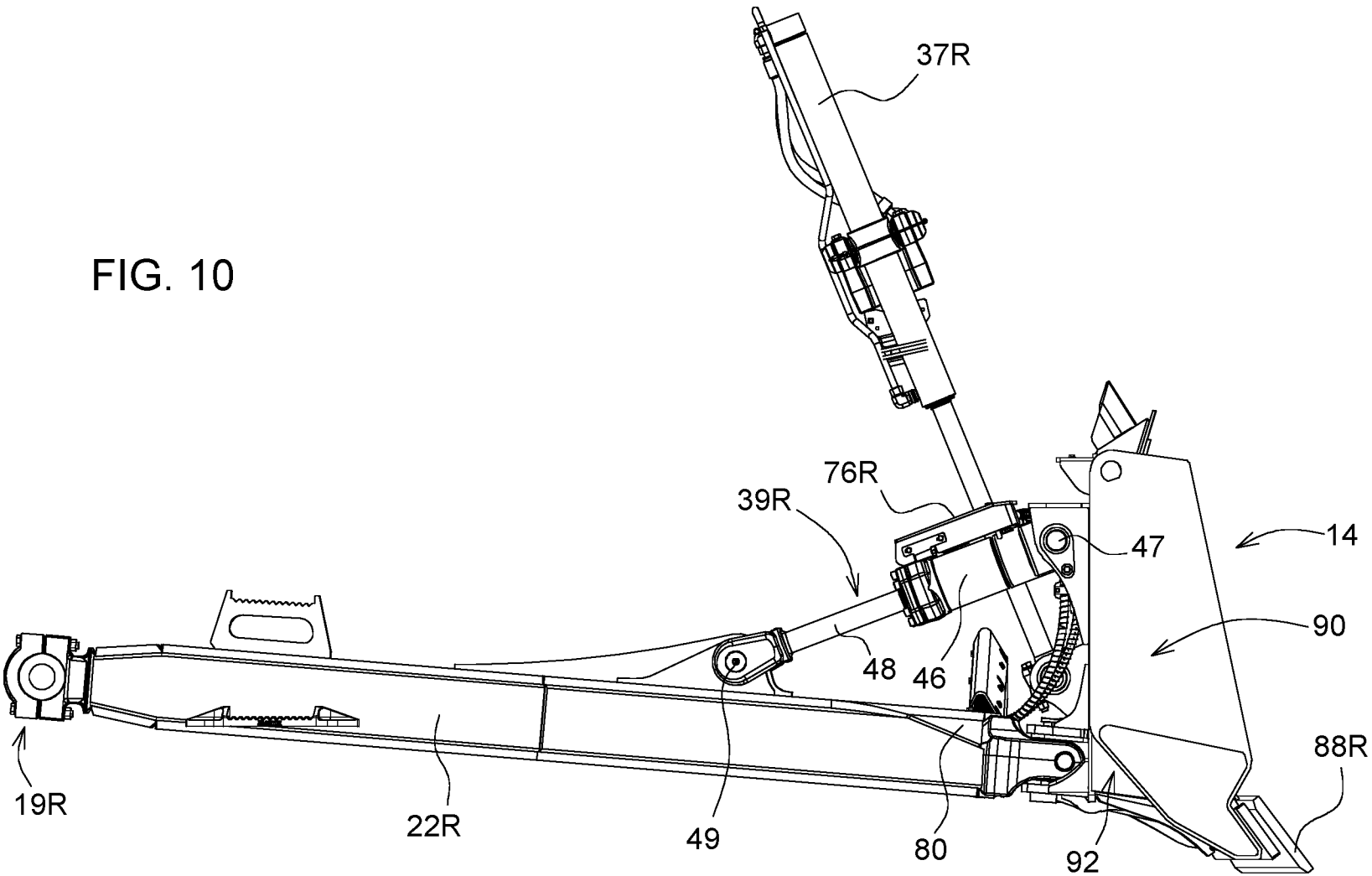
FIG. 10 is an enlarged right side elevation view of the right push beam and the right portion of the dozer blade of either of the work vehicles of FIG. 1A and FIG. 1B.

FIG. 3 shows a front perspective view of the dozer blade 14. The dozer blade 14 includes a front blade surface 86 and left and right end bits 88L and 88R mounted to lower laterally outer left and right corners of the front blade surface 86. A blade supporting structure generally indicated at 90 is located behind the front blade surface 86 to provide structural support to the blade 14 and to provide attachments to the push beams. As best seen in FIGS. 6 and 8 the blade supporting structure 90 includes a cut-away 92 adjacent and laterally outward of the associated one of the push beams. The cut-away 92 may be configured such that the end bit 88R is visible when viewed from the operator's station 18 along the line of sight 56R.

Thus, a number of features are provided which collectively improve the view of the lower laterally outer corner portion 54 of the dozer blade when viewed along the line of sight 56R from the operator's station 18. Similar features are shown in FIGS. 1B, 2B and 4B associated with the left lower laterally outer corner portion of the dozer blade 14 adjacent the left end bit 88L. It is not necessary to provide all of the noted features to improve this view. Generally the more of the features that are provided, the more the view is improved.

In summary, the list of features for collectively improving the view of the lower laterally outer corner portion 54 of the dozer blade 14 when viewed along the line of sight 56R from the operator's station 18 includes:

(1) at least one tilt cylinder 39R including a cylinder portion 46 pivotally connected to the dozer blade 14 and a piston portion 48 pivotally connected to the right push beam 22R, the cylinder portion 46 having a larger outside cross-sectional dimension than the piston portion 48;

(2) the at least one tilt cylinder 39R including a cylinder axis 50 diverging laterally outward relative to the longitudinal central axis 30 of the main frame 13 in a forward direction by a splay angle 52 of at least 2 degrees;

(3) the right push beam 22R connected to the at least one tilt cylinder 39R including a front end portion 58 connected to the dozer blade 14, a rear end portion 60 connected to the right crawler track 21R, and an intermediate portion 62 extending from the rear end portion 60 to the front end portion 58, the front end portion 58 being offset laterally inward relative to the intermediate portion 62 towards the longitudinal central axis 30 of the main frame 13;

(4) a tilt cylinder guard 76R located above the cylinder portion 46 of the at least one tilt cylinder 39R;

(5) a plurality of hoses 78 connected to the at least one tilt cylinder 39R, the hoses 78 being routed upward from the tilt cylinder 39R and laterally inward toward the central longitudinal axis 30 of the main frame 13 away from the tilt cylinder 39R;

(6) the front end portion 58 of the right push beam 22R connected to the at least one tilt cylinder 39R including a cut-away front laterally outside corner 80; and (7) the dozer blade 14 including a front blade surface 86 and a blade supporting structure 90 located behind the front blade surface 86, and the blade supporting structure 90 including a cut-away 92 adjacent a lower laterally outer corner portion 54 of the dozer blade 14.

These features may also be described as collectively contributing to defining a visibility window 94 (see FIG. 12) laterally inward of the right tilt cylinder 39R promoting visibility from the operator's station 18 through the visibility window 94 toward the lower laterally outer corner portion 54 of the dozer blade 14. Preferably the visibility window 94 is configured such that the end bit 88R is visible when viewed from the operator's station 18 along the line of sight 56R.

In one embodiment the work vehicle 10A, 10B may include features (1) and (2).

In another embodiment the work vehicle 10A, 10B may include features (1) and (2) and at least three additional ones of the listed features.

In another embodiment the work vehicle 10A, 10B may include at least three of the listed features.

In another embodiment the work vehicle 10A, 10B may include at least three of the listed features, including features (1) and (2).

In another embodiment the work vehicle 10A, 10B may include at least four of the listed features.

In another embodiment the work vehicle 10A, 10B may include at least five of the listed features.

In another embodiment the work vehicle 10A, 10B may include all seven of the listed features.

Figure 11:
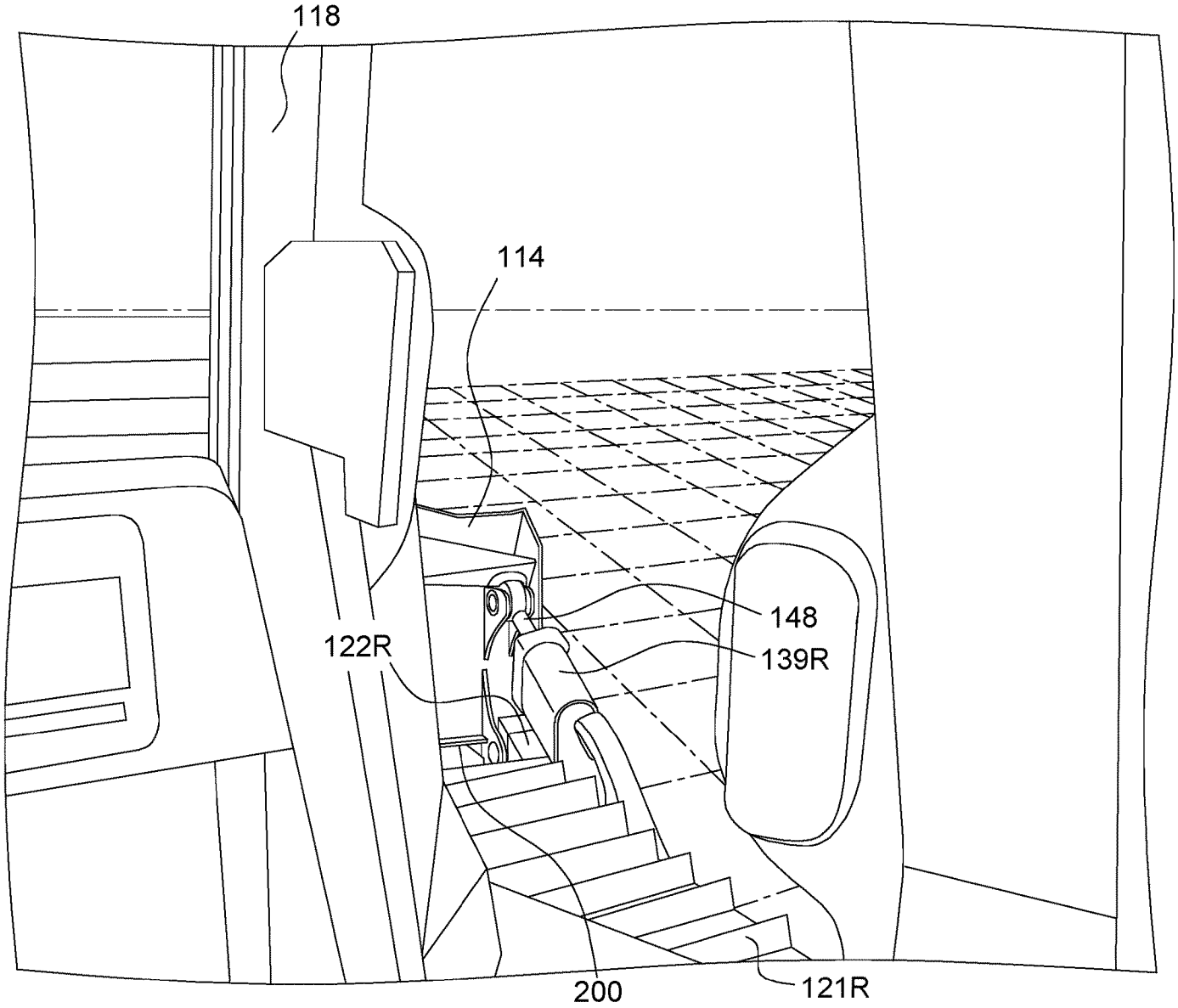
FIG. 11 (Prior Art)
FIG. 11 is a schematic perspective view from the operator's station of a lower laterally outer corner portion of the dozer blade of a prior art machine.
Figure 12:
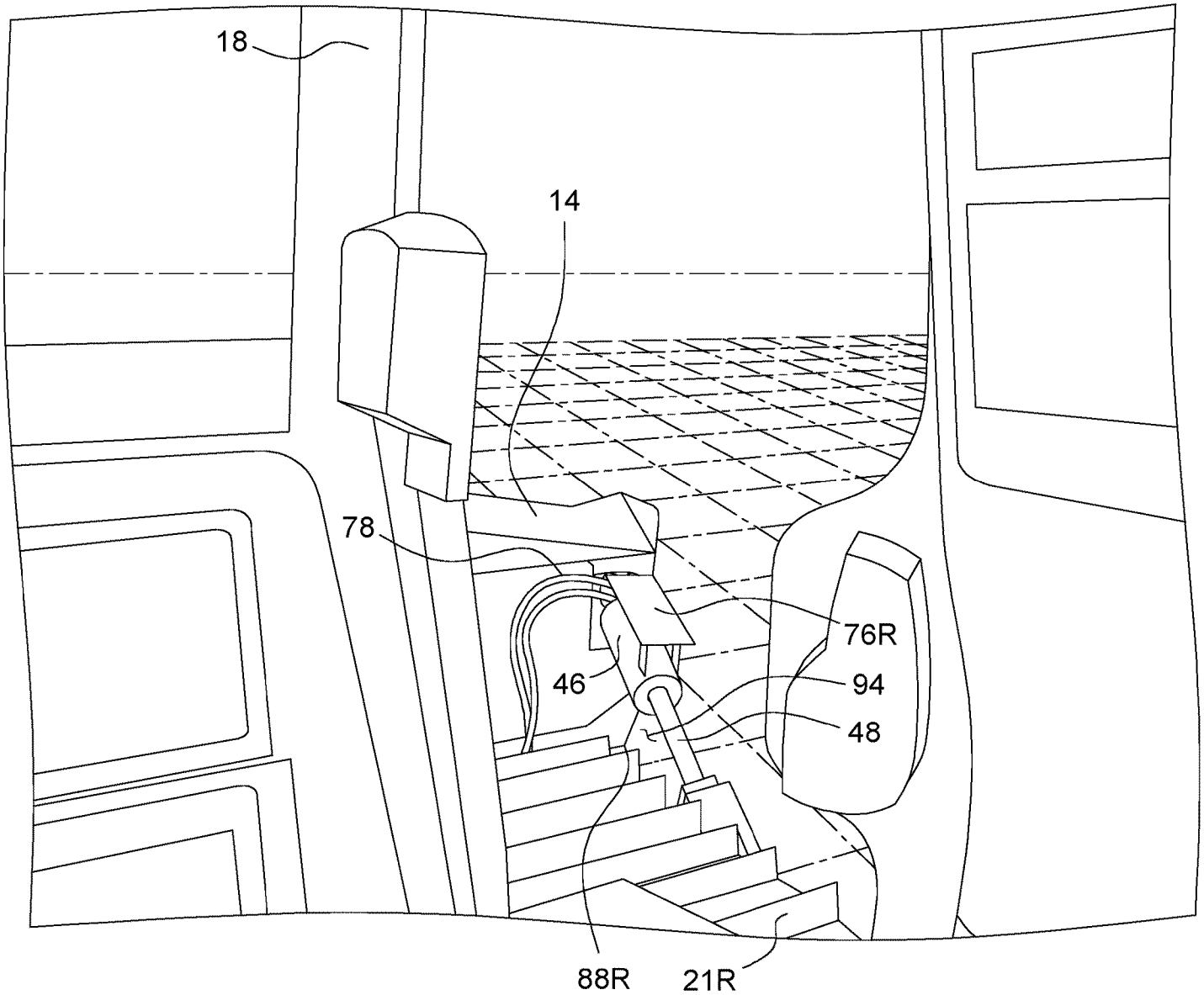
FIG. 12 is a schematic perspective view from the operator's station of a lower laterally outer corner portion of the dozer blade of either of the work vehicles of FIG. 1A and FIG. 1B.

An example of the collective effect of all seven features may be seen in FIG. 12. The improvement may be particularly appreciated in comparison to the view seen in the prior art arrangement of FIG. 11.

FIG. 11 shows an exemplary view from the operator's station of the right portion of the dozer blade for a prior art Deere Model 1050K2 dozer, which is an OSD dozer in which the dozer blade is located sufficiently forward of the crawler tracks that the cutting edge of the dozer blade is visible above the forward ends of the tracks from the operator's station. In FIG. 11 the operator's station is indicated as 118, the dozer blade is indicated as 114, the right crawler track is indicated as 121R, the right tilt cylinder is indicated as 139R with its forward extending piston portion 148, and the right push beam is indicated as 122R. In this prior art dozer, none of the seven features enumerated above are present. Although a portion of the lower edge 200 of the dozer blade is visible, the laterally outer lower corner and especially the corner bit are not visible as they are blocked by the tilt cylinder 139R, the right push beam 122R and other structures.

FIG. 12 shows a similar view from the operator's station 18 of the work vehicle 10A, 10B disclosed herein, in which a tag-link design is used which places the dozer blade 14 much closer to the front of the crawler tracks than was the case in FIG. 11. The lower edge of the dozer blade 14 located in front of the crawler tracks can no longer been seen. But due to the use of the various features disclosed herein, itemized as features (1)-(7) above, the visibility window 94 has been created. The line of sight 56R is now available from the operator's station 18 to the lower laterally outer corner portion 54 of the dozer blade 14. Preferably at least the outer corner of the end bit 88R is visible. In the example shown in FIG. 12 all seven of the listed features have been used. The splay angle is about 4 degrees.

Additionally, in the example of FIG. 12 the tilt cylinder connection to the blade has been raised about 75 mm (compared to FIG. 11) and the tilt cylinder connection to the push beam has been moved rearward about 250 mm, which changes have increased the length of the tilt cylinder 39R by about 250 mm. Also, the width of the dozer blade 14 has been increased by about 4 inches as compared to the prior art design of FIG. 11. These dimensional changes further enhance the visibility window 94 provided by the itemized features (1)-(7).

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A crawler dozer, comprising:

a main frame having a longitudinal central axis extending between a front and a rear of the main frame;

left and right crawler tracks for supporting the main frame from a ground surface;

an operator's station supported from the main frame;

a push frame including left and right push beams located laterally outside of the left and right crawler tracks, respectively;

a dozer blade pivotally connected to the left and right push beams;

a tag-link extending laterally between the dozer blade and the main frame to support the dozer blade and the push frame from the main frame against lateral forces acting against the dozer blade;

at least one tilt cylinder connected between the dozer blade and at least one of the left and right push beams and configured to tilt the dozer blade about a tilt axis transverse to the longitudinal central axis, the at least one tilt cylinder including a cylinder portion pivotally connected to the dozer blade and a piston portion pivotally connected to the at least one of the left and right push beams, the cylinder portion having a larger outside cross-sectional dimension than the piston portion; and wherein the at least one tilt cylinder includes a cylinder axis diverging laterally outward relative to the longitudinal central axis of the main frame in a forward direction by a splay angle of at least 2 degrees such that a view from the operator's station of a lower laterally outer corner portion of the dozer blade is provided along a line of sight passing laterally inward of the piston portion of the at least one tilt cylinder.

2. The crawler dozer of claim 1, wherein:

the splay angle is at least 3 degrees.

3. The crawler dozer of claim 1, wherein:

the splay angle is at least 4 degrees.

4. The crawler dozer of claim 1, wherein:

the at least one of the left and right push beams connected to the piston portion of the at least one tilt cylinder includes a front end portion connected to the dozer blade, a rear end portion connected to a respective one of the crawler tracks, and an intermediate portion extending from the rear end portion to the front end portion, the front end portion being offset laterally inward towards the longitudinal central axis of the main frame relative to the intermediate portion.

5. The crawler dozer of claim 1, further comprising:

a tilt cylinder guard located above the cylinder portion of the at least one tilt cylinder.

6. The crawler dozer of claim 5, wherein:

the tilt cylinder guard is configured such that the tilt cylinder guard covers no more of the lower laterally outer corner portion of the dozer blade when viewed from the operator's station than does the tilt cylinder.

7. The crawler dozer of claim 1, further comprising:

a plurality of hoses connected to the at least one tilt cylinder, the hoses being routed upward from the at least one tilt cylinder and laterally inward toward the central longitudinal axis of the main frame away from the tilt cylinder.

8. The crawler dozer of claim 1, wherein:

the at least one of the left and right push beams connected to the piston portion of the at least one tilt cylinder includes a front end portion connected to the dozer blade and a rear end portion connected to a respective one of the crawler tracks, and the front end portion includes a cut-away front laterally outside corner.

9. The crawler dozer of claim 8, wherein:

the cut-away front laterally outside corner is hidden behind the crawler track adjacent the at least one of the left and right push beams when viewed from the operator's station.

10. The crawler dozer of claim 1, wherein:

the dozer blade includes a front blade surface, an end bit mounted to a lower laterally outer corner of the front blade surface, and a blade supporting structure located behind the front blade surface, and the blade supporting structure includes a cut-away adjacent the lower laterally outer corner portion of the dozer blade, such that the end bit is visible when viewed from the operator's station.

11. The crawler dozer of claim 1, further comprising at least three additional features selected from the group of additional features consisting of:

(1) the at least one of the left and right push beams connected to the piston portion of the at least one tilt cylinder including a front end portion connected to the dozer blade, a rear end portion connected to a respective one of the crawler tracks, and an intermediate portion extending from the rear end portion to the front end portion, the front end portion being offset laterally inward relative to the intermediate portion towards the longitudinal central axis of the main frame;

(2) a tilt cylinder guard located above the cylinder portion of the at least one tilt cylinder;

(3) a plurality of hoses connected to the at least one tilt cylinder, the hoses being routed upward from the tilt cylinder and laterally inward toward the central longitudinal axis of the main frame away from the tilt cylinder;

(4) the front end portion of the at least one of the left and right push beams connected to the piston portion of the at least one tilt cylinder including a cut-away front laterally outside corner; and (5) the dozer blade including a front blade surface and a blade supporting structure located behind the front blade surface, and the blade supporting structure including a cut-away adjacent the lower laterally outer corner portion of the dozer blade; and wherein the selected additional features collectively improve the view of the lower laterally outer corner portion of the dozer blade when viewed from the operator's station.

12. The crawler dozer of claim 1, further comprising:

(1) the at least one of the left and right push beams connected to the piston portion of the at least one tilt cylinder including a front end portion connected to the dozer blade, a rear end portion connected to a respective one of the crawler tracks, and an intermediate portion extending from the rear end portion to the front end portion, the front end portion being offset laterally inward relative to the intermediate portion towards the longitudinal central axis of the main frame;

(2) a tilt cylinder guard located above the cylinder portion of the at least one tilt cylinder;

(3) a plurality of hoses connected to the at least one tilt cylinder, the hoses being routed upward from the tilt cylinder and laterally inward toward the central longitudinal axis of the main frame away from the tilt cylinder;

(4) the front end portion of the at least one of the left and right push beams connected to the piston portion of the at least one tilt cylinder including a cut-away front laterally outside corner; and (5) the dozer blade including a front blade surface and a blade supporting structure located behind the front blade surface, and the blade supporting structure including a cut-away adjacent the lower laterally outer corner portion of the dozer blade.

13. The crawler dozer of claim 1, wherein:

the at least one tilt cylinder includes left and right tilt cylinders connected between the dozer blade and the left and right push beams, respectively.

14. A crawler dozer, comprising:

a main frame having a longitudinal central axis extending between a front and a rear of the main frame;

left and right crawler tracks for supporting the main frame from a ground surface;

an operator's station supported from the main frame;

a push frame including left and right push beams located laterally outside of the left and right crawler tracks, respectively;

a dozer blade pivotally connected to the left and right push beams;

a tag-link extending laterally between the dozer blade and the main frame to support the dozer blade and the push frame from the main frame against lateral forces acting against the dozer blade;

at least one tilt cylinder connected between the dozer blade and at least one of the left and right push beams and configured to tilt the dozer blade about a tilt axis transverse to the longitudinal central axis; and at least three additional features selected from the group of additional features consisting of:

(1) the at least one tilt cylinder including a cylinder portion pivotally connected to the dozer blade and a piston portion pivotally connected to the at least one of the left and right push beams, the cylinder portion having a larger outside cross-sectional dimension than the piston portion;

(2) the at least one tilt cylinder including a cylinder axis diverging laterally outward from the longitudinal central axis of the main frame in a forward direction by a splay angle of at least 2 degrees;

(3) the at least one of the left and right push beams connected to the at least one tilt cylinder including a front end portion connected to the dozer blade, a rear end portion connected to a respective one of the crawler tracks, and an intermediate portion extending from the rear end portion to the front end portion, the front end portion being offset laterally inward relative to the intermediate portion towards the longitudinal central axis of the main frame;

(4) a tilt cylinder guard located above the cylinder portion of the at least one tilt cylinder;

(5) a plurality of hoses connected to the at least one tilt cylinder, the hoses being routed upward from the tilt cylinder and laterally inward toward the central longitudinal axis of the main frame away from the tilt cylinder;

(6) the front end portion of the at least one of the left and right push beams connected to the at least one tilt cylinder including a cut-away front laterally outside corner; and (7) the dozer blade including a front blade surface and a blade supporting structure located behind the front blade surface, and the blade supporting structure including a cut-away adjacent a lower laterally outer corner portion of the dozer blade; and wherein the selected additional features collectively contribute to defining a visibility window laterally inward of the at least one tilt cylinder promoting visibility from the operator's station through the visibility window toward the lower laterally outer corner portion of the dozer blade.

15. The crawler dozer of claim 14, wherein:

the at least three additional features selected include features (1) and (2).

16. The crawler dozer of claim 14, wherein:

the at least three additional features selected include at least four of the additional features.

17. The crawler dozer of claim 14, wherein:

the at least three additional features selected include at least five of the additional features.

18. The crawler dozer of claim 14, wherein:

the at least three additional features selected include all additional features (1)-(7).

19. The crawler dozer of claim 14, wherein:

the dozer blade includes a front blade surface and an end bit mounted to the front blade surface; and wherein the visibility window is configured such that the end bit is visible when viewed from the operator's station.

* * * * *